United States Patent [19]

Roberts

[11] 4,074,428

[45] Feb. 21, 1978

[54] POCKET RAZOR AND SHAVE CREAM DISPENSER

[76] Inventor: Raymond P. Roberts, Box 1117, Tulsa, Okla. 74101

[21] Appl. No.: 765,611

[22] Filed: Feb. 4, 1977

[51] Int. Cl.[2] ..... B26B 19/38

[52] U.S. Cl. ..... 30/41; 30/86

[58] Field of Search ..... 30/41, 86; 222/319, 222/320

[56] References Cited

U.S. PATENT DOCUMENTS

| | | | |
|---|---|---|---|
| 1,623,690 | 4/1927 | Little | 222/320 |
| 1,948,054 | 2/1934 | Stringfellow | 222/320 |
| 1,950,769 | 3/1934 | Barr | 30/41 |
| 2,053,550 | 9/1936 | Chodaczok | 30/86 |
| 2,669,017 | 2/1954 | Seko | 30/41 |

*Primary Examiner*—Robert C. Watson

*Attorney, Agent, or Firm*—Head, Johnson & Chafin

[57] ABSTRACT

A pocket-size razor and shave cream dispenser comprising a razor carried by a housing member having an internal chamber for receiving a supply of shave cream therein, a plunger member secured to the housing oppositely disposed from the razor and extending reciprocally into the chamber, a longitudinal passageway extending through the plunger and having one end thereof in communication with the internal chamber and the opposite end thereof open whereby the shave cream is forced outwardly through the passageway upon movement of the plunger member in one direction, an end cap member removably secured to the outer end of the plunger member for selectively closing the passageway to seal the shave cream in the chamber, and an elongated tubular cover member removably secured in the housing in the proximity of the razor for encasing the razor during periods of non-use.

4 Claims, 4 Drawing Figures

POCKET RAZOR AND SHAVE CREAM DISPENSER

BACKGROUND OF THE INVENTION

1. Field of the Invention

This invention relates to improvements in razors and more particularly, but not by way of limitation, to a combination razor and shave cream dispenser of a size convenient for carrying in a pocket, or the like.

2. Description of the Prior Art

It is frequently desirable to use a razor and associated shave cream at times and in places away from the usual areas wherein this grooming process is normally handled, such as when traveling, or during long working hours which do not permit sufficient free time for the usual shaving procedure. As a consequence, many persons keep relatively small and lightweight razors with their luggage items, or in a desk drawer, or the like, for use during these somewhat abnormal occasions. Although many of these razors are provided with carrying cases, these cases are frequently somewhat inconvenient for carrying or storing in a small place, in addition to which it is usually necessary to carry a supply of shave cream for use with the razor.

SUMMARY OF THE INVENTION

This invention contemplates a novel combination razor and shave cream dispenser particularly designed and constructed for overcoming the foregoing disadvantages. The novel device comprises a relatively small housing having one end thereof adapted for removably receiving the handle of a small lightweight razor thereon. An internal chamber, separate from the razor, is provided in the housing for receiving a supply of shave cream therein. A plunger member is secured to the opposite end of the housing and extends reciprocally into the chamber. The plunger is provided with a passageway extending longitudinally therethrough with one end of the passageway being in open communication with the chamber and the opposite end thereof being open, whereby the shave cream is forced through and out of the chamber when the plunger is moved in one direction within the chamber. An end cap member is removably secured to the outer end of the plunger for selectively closing the open end of the passageway in order to seal the shave cream in the chamber when the device is not in use. In addition, a tubular cover member is removably secured to the housing in the proximity of the razor for encasing the razor when not in use. If desired, a suitable clip member may be provided on the outer periphery of the tubular cover member for engagement with the usual pocket, or the like, for facilitating the carrying or transporting and storing of the device between usage periods. The novel device is simple and efficient in operation and economical and durable in construction.

DESCRIPTION OF THE PREFERRED EMBODIMENT

Figure 1:
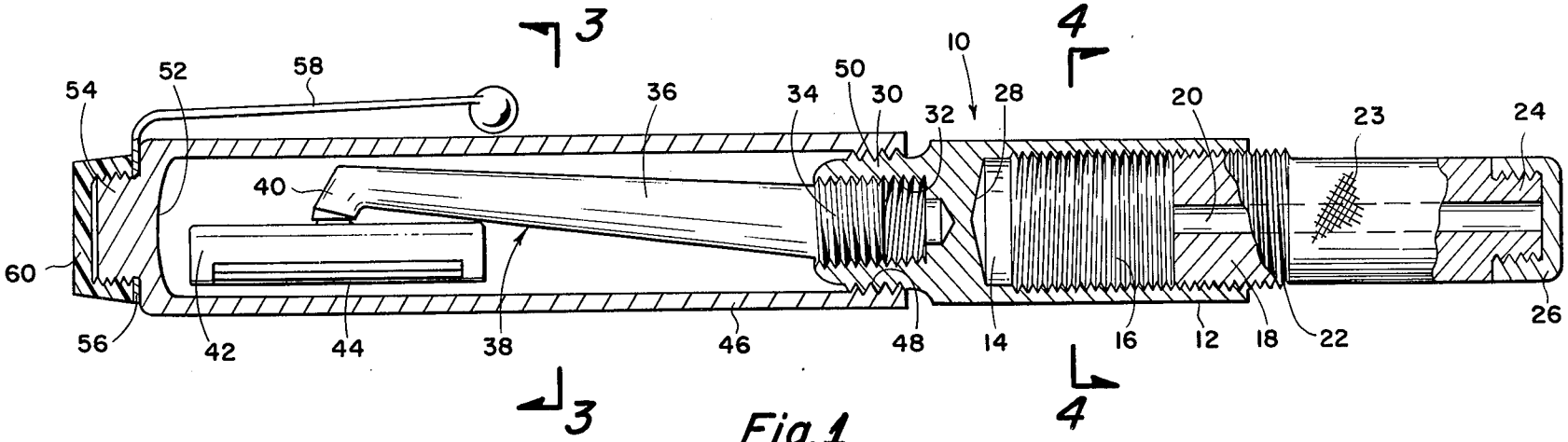
FIG. 1 is a sectional elevational view of a pocket-size combination razor and shave cream dispenser embodying the invention.

Referring to the drawings in detail, reference character 10 generally indicates a combination razor and shave cream dispenser containing a housing 12 having an internal chamber 14 therein for receiving a suitable shave cream (not shown) therein. The outer end of the chamber 14 is open, and the inner periphery thereof is threaded as shown at 16 for receiving one end of an externally threaded plug-type plunger 18 therein. A centrally disposed passageway extends longitudinally through the plunger 18 and has one end thereof in open communication with the chamber 14 and the opposite end thereof open for a purpose as will be hereinafter set forth. The external threads of the plunger preferably terminate at a point 22 as particularly shown in FIG. 1, and the remaining portion of the outer periphery of the plunger 18 is preferably knurled or otherwise roughened as shown at 23 for facilitating manipulation thereof during use of the device 10. In addition, a reduced neck portion 24 is provided at the outer end of the plunger 18 and is externally threaded for removably receiving a suitable end cap member 26 thereon. The end cap member 26 may be secured to the neck portion 24 in order to close the passageway 20 from exposure to the atmosphere as will be hereinafter set forth.

Figure 2:
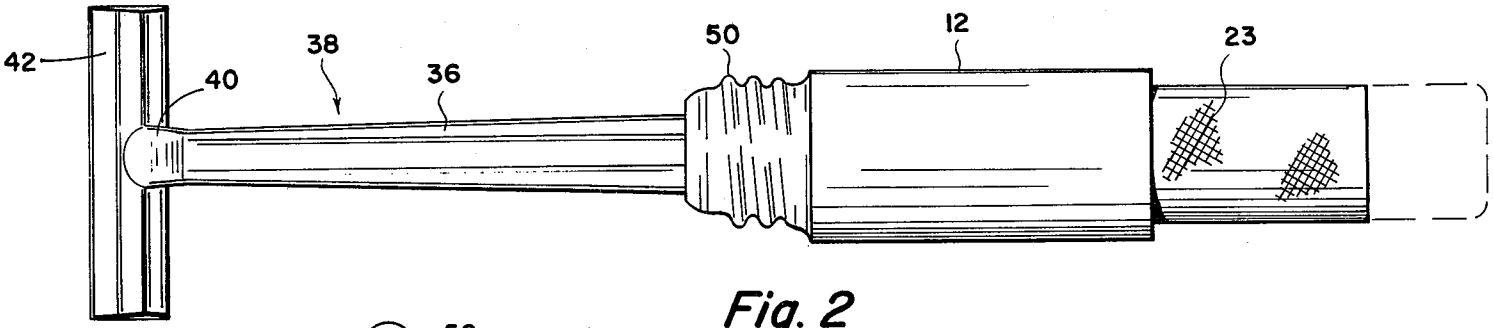
FIG. 2 is a side elevational view of a pocket-size combination razor and shave cream dispenser embodying the invention with portions depicted in broken lines for purposes of illustration.
Figure 4:
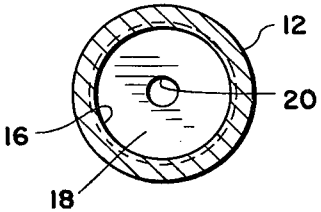
FIG. 4 is a sectional view taken on line 4—4 of FIG. 1.
Figure 3:
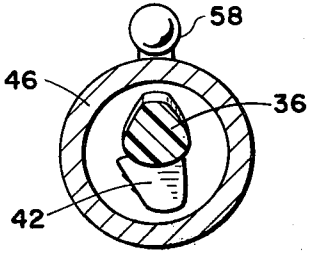
FIG. 3 is a sectional view taken on line 3—3 of FIG. 1.

The inner end of the chamber 14 is closed by a suitable wall 28 and a reduced neck portion 30 extends longitudinally therefrom in a direction away from the chamber 14. A centrally disposed threaded bore 32 is provided in the neck member 20 for threadedly receiving a threaded stem 34 provided on one end of a handle 36 of a razor generally indicated at 38. As particularly shown in FIG. 1, the axis of the handle member 36 is preferably angularly disposed with respect to the axis of the stem 34 in one plane, but in substantial alignment therewith in a perpendicular plane as shown in FIG. 2. The handle 36 is preferably provided with an angularly extending connection member 40 at the outer end thereof, and a suitable blade holder 42 is pivotally secured to the connection member 40 in any well-known manner (not shown), whereby the blade holder 42 may be selectively moved between a first locked position substantially parallel with the handle 36 as shown in broken lines in FIG. 2 and a second locked position substantially perpendicular thereto, as shown in solid lines in FIG. 2. Of course, any suitable razor blade 44 may be removably secured to the blade holder 42 in any well-known manner in order that the razor 38 may be utilized in the usual manner during a shaving operation.

An elongated substantially tubular cover member 46 is provided for connection with the housing 12 in order to encase the razor 38 for protection thereof during periods of nonuse. The cover 46 as shown herein is provided with one externally threaded portion 50 provided on the neck 30. The opposite end of the cover 46 is closed by a wall 52; and, if desired, a reduced diameter threaded stem 54 may be provided on the outer portion of the wall 52 whereby an apertured leg 56 of a suitable clip member 58 may be disposed around the stem 54 and retained in engagement with the outer portion of the wall 52 by a suitable threaded cap member 60.

In use, the chamber 14 may be filled with a suitable shave cream material (not shown) by removing the plunger 18 from the chamber 14 for providing free access thereto. Subsequent to filling the chamber 14 with the desired quantity of shave cream, the plunger 18 may be threadedly engaged with the threaded portion 16 through a sufficient distance whereby the inwardly directed end of the plunger is either in engagement with the shave cream material, or extended into the supply thereof a sufficient distance for the shave cream to fill the passageway 20. At this time it is usually preferable to have the cap member 26 secured to the stem or neck 24 in order that the outer end of the passageway 20 will be closed for precluding accidental discharge of the shave cream from the passageway. The blade holder 42 is preferably manually positioned in the disposition thereof substantially parallel to the handle 36 as shown in FIG. 1 and in broken lines in FIG. 2, and the razor 38 may then be inserted into the interior of the cover member 46. The cover member 46 may be threadedly secured to the housing 12, and the entire device 10 may be conveniently stored in a desk drawer, or the like, or may be clipped to a pocket (not shown) of the user by means of the clip member 58 in the usual or well-known manner.

When it is desired to use the device 10 for a shaving operation, the cover 46 may be removed from the housing 12, and the blade holder 42 may be manually rotated to a position substantially perpendicular to the handle 36 as shown in solid lines in FIG. 2; and if necessary, a suitable razor blade 44 may be installed in the holder 42. The end cap 26 may be removed from engagement with the neck 24, thus opening the passageway 20 to the atmosphere. The plunger 18 may be manually rotated with respect to the housing 12 by manually grasping the roughened portion 23 and rotating the plunger about its own longitudinal axis in a direction for moving the plunger 18 inwardly with respect to the chamber 14. This movement of the plunger forces a quantity of the shave cream from the chamber 18 into the passageway 20 for discharge to the atmosphere from the outer end of the passageway 20. Of course, the shave cream discharging from the passageway 20 may be retrieved in the hand of the user of the device for use during a shaving operation in the usual manner. The housing 12 and exposed portion of the plunger 18 provide a handle for the razor during the shaving operation. However, if it is desired, the handle 36 may be removed from its connection with the neck member 30, and the razor may be used independently of the housing 12 during the shaving operation.

Subsequent to the shaving operation, the razor may be replaced in connection with the neck 30 and the cover member 46 may be replaced over the razor 38 and re-engaged with the neck 30. The end cap 26 may be replaced on the neck 24 and the entire device 10 may again be stored as hereinbefore set forth until such time as it is desired to use the device 10 again.

From the foregoing, it will be apparent that the present application provides a novel pocket-size combination razor and shave cream dispenser comprising a housing having an internal chamber for storing a quantity of shave cream therein. A razor is carried at one end of the housing, and the opposite end thereof is open for receiving a reciprocal plunger therein. The plunger is provided with a passageway extending longitudinally therethrough providing communication between the internal chamber and the atmosphere whereby movement of the plunger in one direction forces shave cream through the passageway for discharge therefrom in order that the shave cream may be utilized in the normal manner with the razor for performing a shaving operation.

Whereas the present invention has been described in particular relation to the drawings attached hereto, it should be understood that other and further modifications, apart from those shown or suggested herein may be made within the spirit and scope of this invention.

What is claimed is:

1. A pocket-size combination razor and shave cream dispense comprising housing means having an internally threaded chamber therein for receiving a quantity of shave cream therein, an externally threaded plug-type plunger member threadedly secured directly to the inner periphery of the chamber at one end thereof and extending into the chamber, said plug-type plunger member having a central bore extending longitudinally therethrough providing communication between the chamber and the atmosphere whereby movement of the plug-type plunger member in one direction with respect to the chamber forces the shave cream through the bore for discharge into the atmosphere, end cap means removably secured to the outer end of the plunger member for selectively closing the outer end of the bore, razor means removably secured to the housing means and extending longitudinally outwardly therefrom in a direction away from said plunger member whereby said plunger member is operable without removal of the razor from the housing means, and cover means removably secured to said housing in the proximity of said razor means for selectively encasing said razor during periods of non-use.

2. A pocket-size combination razor and shave cream dispenser as set forth in claim 1 and including clip means carried by said cover means for facilitating securing said combination razor and shave cream dispenser to a pocket.

3. A pocket-size combination razor and shave cream dispenser as set forth in claim 1 wherein said razor comprises handle means removably secured to said housing means, blade holder means pivotally secured to the outer end of said handle means and movable between a first position in substantial alignment with the handle means and a second position substantially perpendicular to the handle means.

4. A pocket-size combination razor and shave cream dispenser as set forth in claim 1 wherein the end of the housing means oppositely disposed with respect to the plunger means is provided with a threaded bore for receiving the razor means therein, and the outer periphery of said housing means surrounding said threaded bore is threaded for removably receiving said cover means thereon.

* * * * *